United States Patent [19]

Dorne

[11] 4,186,403

[45] Jan. 29, 1980

[54] ANTENNA FORMED OF NON-UNIFORM SERIES CONNECTED SECTIONS

[76] Inventor: Arthur Dorne, Box 624, Setauket, N.Y. 11785

[21] Appl. No.: 869,098

[22] Filed: Jan. 13, 1978

Related U.S. Application Data

[63] Continuation of Ser. No. 593,951, Jul. 8, 1975, abandoned.

[51] Int. Cl.[2] ..... H01Q 9/28

[52] U.S. Cl. ..... 343/801; 343/828

[58] Field of Search ..... 343/731, 735, 738, 801, 343/827, 828, 908, 899

[56] References Cited

U.S. PATENT DOCUMENTS

| | | | |
|---|---|---|---|
| 1,610,704 | 12/1926 | Paddack | 343/908 |
| 1,967,881 | 7/1934 | Green | 343/827 |
| 2,210,491 | 8/1940 | Lewis | 343/827 |
| 2,380,333 | 7/1945 | Scheldorf | 343/801 |
| 2,750,589 | 6/1956 | Harris | 343/827 |
| 3,737,907 | 6/1973 | Monola | 343/752 |
| 3,806,946 | 4/1974 | Tiuri | 343/731 |
| 4,021,810 | 5/1977 | Urpo et al. | 343/731 |

FOREIGN PATENT DOCUMENTS

| | | | |
|---|---|---|---|
| 798821 | 7/1958 | United Kingdom | 343/708 |

*Primary Examiner*—Eli Lieberman

*Attorney, Agent, or Firm*—Darby & Darby

[57] ABSTRACT

An antenna comprising a collinear array of "thick" and "thin" elements selected to produce a given current distribution so that when the antenna is vertically polarized a circular horizontal plane pattern and a highly directional vertical plane pattern are produced which has a single principal lobe directed generally at the horizon.

24 Claims, 25 Drawing Figures

ANTENNA FORMED OF NON-UNIFORM SERIES CONNECTED SECTIONS

This application is a continuation of my prior copending application Ser. No. 593,951, filed July 8, 1975, which application is now abandoned.

In many applications it is desired to have a vertically polarized antenna which provides a circular horizontal plane pattern and a highly directional vertical plane pattern which has a single principal lobe directed at the horizon. Antennas of this category having gains at the horizon of 3 to 10 db above that of a half wave dipole are frequently utilized in communication systems at VHF and higher frequencies to optimize performance and cost relationships. Examples of systems which use this type of antenna are those used for communication from fixed stations to automotive vehicles with the high gain antenna of the type considered here used at the fixed station.

The present invention relates to an improved antenna for producing a radiation pattern of the foregoing type which makes possible either an increase in the operating bandwidth of the antenna, thereby increasing the number of messages which can be transmitted or received simultaneously, or which reduces the size, weight and cost of antennas having bandwidths comparable to those obtained with existing antennas.

From antenna theory it can be derived that a radiating structure that is many wavelengths in height is required to produce radiation in a circular horizontal plane at a level which significantly exceeds that produced by a half wave dipole. In principal, an array of collinear dipoles with equal, in-phase excitation over a band of frequencies will achieve the desired characteristics. In practice, there are difficulties in achieving such an array. For example, if each dipole is supplied energy by a separate transmission line, the transmission lines to the upper dipoles disturb the performance of the dipoles below them whether the lines are brought through or alongside them.

If antenna elements are connected end to end to avoid individual transmission lines, the desired uniform excitation is obtained only if some special arrangement is utilized to suppress the long wire mode of radiation of the structure. As is known in the antenna art, a simple long wire (i.e. one a wavelength or more in length) does not produce a radiation pattern with a principal main lobe perpendicular to the wire because radiation from alternate half wave lengths of the wire are of opposite phase.

Prior attempts to devise means of producing uniform excitation have been generally along the following three lines:

(1) The use of indivudually fed dipoles with the requisite excitation achieved by running the transmission lines for the upper elements through the elements below them and incorporating chokes or other means of decoupling the transmission lines from the dipoles.

(2) The use of individually fed dipoles arrayed along and around a mast interconnected by a corporate feed on (or in) the mast.

(3) The utilization of series fed dipoles with in-phase excitation achieved either by means of series reactances (Franklin British Pat. Nos. 285,106 and Scheldorf U.S. Pat. Nos. 2,852,774, 2,896,206 and 3,071,771) or reverse connected short transmission line sections every half wavelength, more or less (Blumlein U.S. Pat. No. 2,115,761 and Bryson U.S. Pat. No. 3,031,668).

The present invention relates to an antenna generally of the third category discussed above. However, it utilizes neither series reactances nor reverse connections. Instead, it utilizes a number of elements connected as a long radiating collinear array with the elements being of different "thickness" (e.g. different diameters). The relative dimensions ("thicknesses") of the various elements are selected to produce a standing wave pattern along the length of the array which has different current amplitudes in each alternate half wavelength of the array. In accordance with a preferred form of vertically polarized antenna made in accordance with the invention, by properly selecting the thicknesses of alternate adjacent elements a circular plane pattern and a highly directional vertical plane pattern with a single lobe directed principally at the horizon can be produced.

It is therefore an object of the present invention to provide a novel long wire type of antenna.

A further object is to provide a novel collinear array type antenna.

An additional object is to provide a vertically polarized collinear array type antenna capable of producing a circular horizontal plane pattern and a highly directional vertical plane pattern having a single principal lobe directed at the horizon.

Yet another object is to provide a collinear array type antenna with alternate sections having different current amplitude distributions.

Another object is to provide a collinear array type antenna with alternate sections of different thickness so as to produce different current amplitude distributions on the alternate sections.

Still a further object is to provide a vertically polarized collinear array type antenna with alternate sections of different thickness so as to produce different current amplitude distributions on the alternate sections which antenna produces a circular horizontal plane pattern and a highly directional vertical plane pattern having a single principal lobe directed at the horizon.

Other objects and advantages of the present invention will become more apparent upon reference to the following specification and annexed drawings, in which.

Figures 1A, 1B:
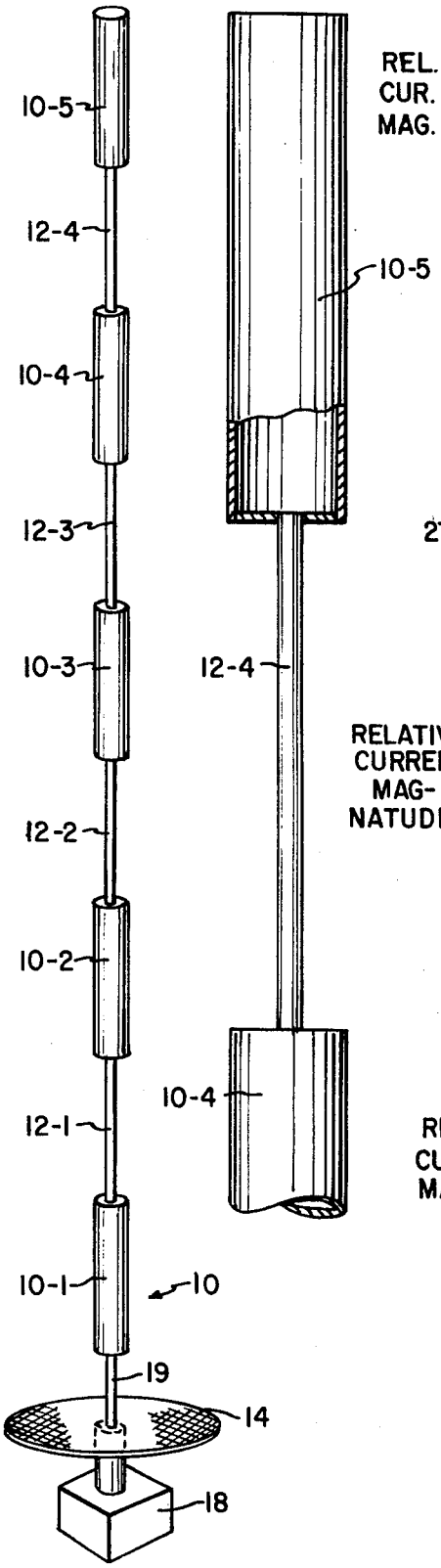
FIG. 1A is a diagrammatic representation of one type of antenna illustrating the principles of the subject invention.
FIG. 1B is a cross-sectional view of the upper portion of the antenna of FIG. 1A.

FIGS. 1 and 1A illustrate the principles of an antenna constructed in accordance with the present invention. In accordance with the invention, a collinear array of thick and thin antenna elements of different diameters is provided. As illustratively shown, each of the antenna elements is a conductive cylinder. Two sets of elements 10 and 12 are provided which are arranged in a collinear (end-to-end) array. Each of the elements of the sets 10 and 12 is substantially one-half wavelength long at the nominal antenna operating frequency. The elements of the two sets are of two different diameters. The first set 10 comprises five elements 10-1 through 10-5 which are of relatively large diameter (the so-called "thick" elements). These are connected by four elements 12-1 through 12-4 of smaller diameter (the so-called "thin" elements). The terms "thick" and "thin" are used throughout the specification and claims to designate the sizes of the respective antenna elements in terms primarily of radiating surface area. That is, a "thick" element will have more surface area per unit of length for radiating energy than a thin element.

Each thin element 12 is conductively connected between two larger diameter, thick elements. For example, thin element 12-1 is connected between thick elements 10-1 and 10-2, thin element 12-2 between thick element 10-2 and 10-3 and so forth down the line. The antenna is vertically polarized above a ground, or a reflecting element such as screen 14, and is supplied energy by a suitable source 18 through a conductor 19 connected to the lowest element 10-5.

FIG. 1B shows a cross-section of the upper portion of the antenna. As seen, the elements 10 and 12 are of hollow cylindrical construction. Any suitable material can be used, for example copper, plated copper, etc. While cylinders are shown, since they are relatively easy to fabricate, other shapes (for example, polygonal, screens, wires, etc.) can be used for the elements. This is described in detail below.

Figure 1C:
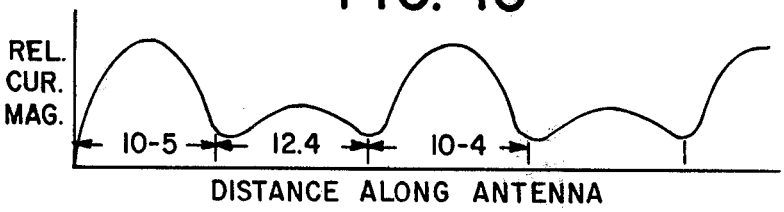
FIG. 1C is a representation of the current distribution for the antenna of FIG. 1A for one possible ratio of diameters of the various elements.

FIG. 1C is a graphical representation of the approximate current distribution along a portion of the antenna structure of FIG. 1A for one possible ratio of diameters of the elements 10 and 12. The Y-axis portrays the relative current amplitude along the length of the antenna represented on the X-axis. In the illustrative antenna described, the current amplitude in the large diameter (thick) elements 10 is approximately twice that of the smaller diameter (thin) elements 12. The current amplitude ratio changes in a manner related to the ratio of the element diameters. The current distribution for each thick and thin element of the antenna is substantially as shown for the first four.

In an antenna electrical standing wave energy pattern, the phase of the current essentially reverses every half wavelength. Therefore, thick elements 10-1 through 10-5 would be expected to radiate like a uniformly excited collinear array. Thin elements 12-1 through 12-4 would also radiate as a collinear array. The overall radiation pattern would be that of the five larger diameter elements 10 less that of the four smaller diameter elements 12. Since the current amplitude is greater in the elements 10, the summation of the product of the current amplitude times the length of the current paths of the array formed by the five thick elements 10 is approximately $2\frac{1}{2}$ times as great as that from the array of the four elements 12 and the resultant pattern produced by the current on all nine elements will closely resemble that which would be produced by the current on the array of five elements 10 alone. The principal difference is that the main lobe produced by the entire array of elements 10 and 12 is somewhat sharper and the side lobes somewhat higher and greater in number than they would be if an array comprising only elements 10-1 through 10-5 were utilized.

Figure 2A:
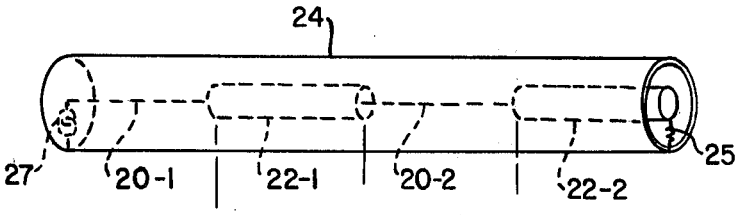
FIG. 2A shows an idealized transmission line structure illustrating the principles of operation of the antenna.
Figure 2C:
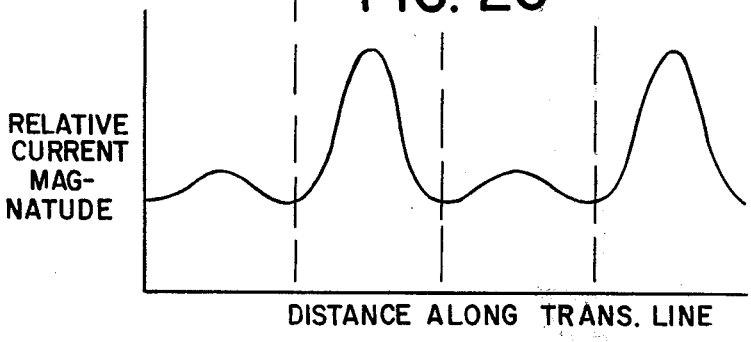
FIGS. 2B and 2C show the two different possible types of current distribution for the transmission line structure of FIG. 2A.
Figure 2B:
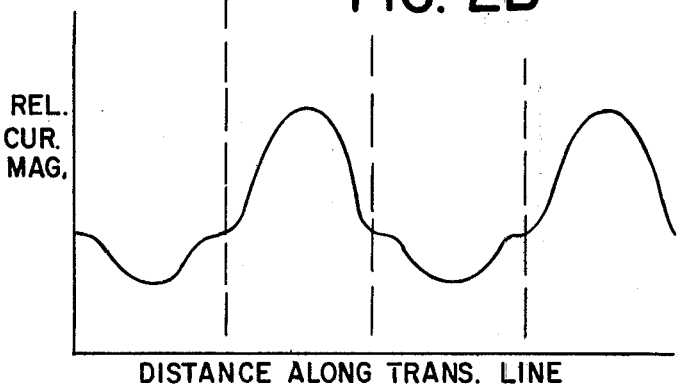

The reason why the array of FIG. 1 produces the described current distribution can be explained by an analogy to an idealized transmission line structure such as shown in FIGS. 2A-2C. FIG. 2A shows a transmission line structure having alternate electrically conductive sections 20 and 22 of different diameters. Each of the sections 20 and 22 is a half wavelength long and the sections are conductively coupled. The transmission line is completed by a cylindrical outer conductor 24 which serves as the common conductor. The transmission line is fed by a suitable generator 27 at a desired frequency at the input of section 20-1 and a resistive termination 25 is connected between the end section 22-2 and the outer conductor 24.

Due to their different diameters, sections 20 and 22 have different characteristic impedances. The termination resistor 25 is larger than the characteristic impedance of the last section 22-2. This produces a finite standing wave ratio along the line. It is assumed that where are no stray capacitances or other circuit elements not indicated on the diagram. The sections 22 have a lower impedance than the sections 20.

Two different types of current districution for the transmission line structure of FIG. 2A are possible and these are shown in FIGS. 2B and 2C. These current distributions are determined in the following manner.

From transmission line theory the power flowing along a lossless transmission line is given by:

$$P = I_{max} \times I_{min} \times Z_0 \quad (1)$$

where:

P = Power flowing along line $I_{max}$=Maximum current $I_{min}$=Minimum current $Z_0$=characteristic impedance.

If a set of lossless transmission line sections are connected in series, with the furthest one terminated by a resistance, the powers transmitted through all of the sections are equal and each of these powers is equal to the power absorbed by the termination. The higher the characteristic impedance of a section the lower the level of its current distribution.

In the case of FIG. 2:

$$P=I_{max1}\times I_{min1}\times Z_{01}=I_{max2}\times I_{min2}\times Z_{02}=I_T^2R_T \quad (2)$$

where the subscripts "1" denote the higher impedance sections and the subscripts "2" denote the lower impedance sections and the subscripts "T" denote the termination.

Because the termination is resistive there must be either a maximum or minimum of $I_2$ at the far end of the transmission line and in fact since $R_T$ has been defined as larger than $Z_{02}$ it must be a minimum which is present. Further, because each line section is one half wave long, $I_2$ must also be of the same value at every junction. Therefore the impedance seen at its far end by each high impedance section is also $R_T$. From this it can be seen that when $Z_{01}$ is larger than $R_T$, $I_1$ is maximum at the junction, and when $Z_{01}$ is smaller than $R_T$, $I_1$ is minimum at the junction. The first of these cases then gives $$I_{max1}=I_{min2}$$

Substitution in equation (2) gives the relative values of the currents midway between the junctions.

For the first condition (FIG. 2B):

$$I_{min1}Z_{01}=I_{max2}Z_{02}$$

$$(I_{min\ 1}/I_{max\ 2})=(Z_{02}/Z_{01})$$

For the second condition (FIG. 2C):

$$I_{max\ 1}Z_{01}=I_{max2}Z_{02}$$

$$(I_{max\ 1}/I_{max\ 2})=(Z_{02}/Z_{01})$$

Thus the values of the current at every maximum and minimum are obtained, which is sufficient to define the curves shown in the FIGS. 2B and 2C.

With actual antennas the situation is considerably more complex and the current distributions are not exactly like either of the examples shown. However, they do tend to correspond to one case or the other, depending upon dimensions of the various elements. The factors which exist with actual antennas but which do not in the transmission line analogy and which prevent exact correspondence include the following:

(1) The principal loss in an antenna is produced by radiation along the structure rather than by a terminating resistance such as 25 in FIG. 2A.

(2) The characteristic impedance of an antenna is not precisely constant through any one section, and, in the case of the antenna of FIG. 1 it is not equal in all of the thick sections or all of the thin ones.

(3) The abrupt changes of diameter between the different diameter elements of the antenna result in shunt capacitances at the junctions between adjacent elements.

(4) With a practical antenna, operation over a band of frequencies rather than at just only a particular one is normally desired. Therefore, the sections are not exactly one-half wavelength long at most conditions of operation.

It has been found that the proportions of the antenna elements which produce the desired current distribution and, therefore, the desired radiation characteristics are somewhat different from those of the transmission line case shown in FIG. 2.

Figure 3A:
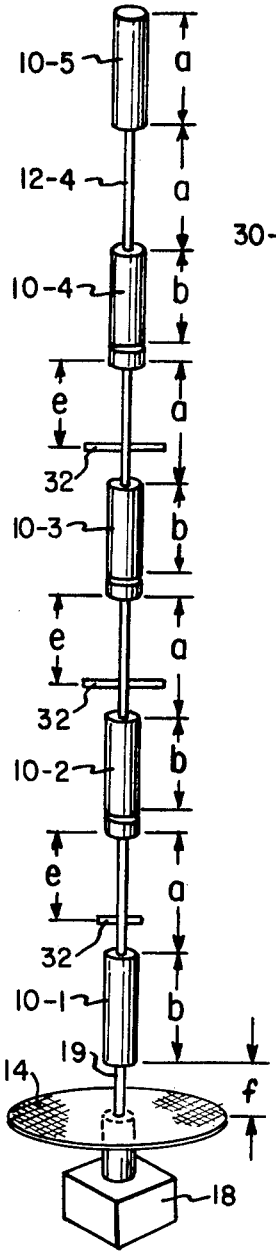
FIG. 3 is a representation of an antenna made in accordance with the invention with means for adjusting the current distribution thereon.
Figure 3B:
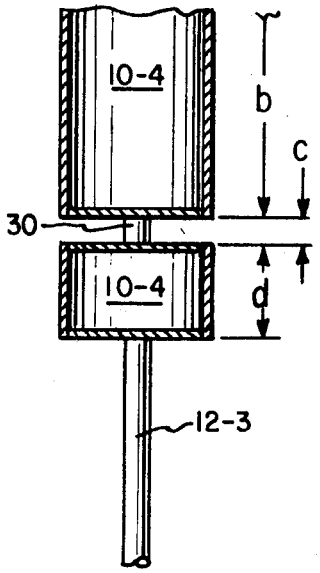

Certain modifications can be made to the basic antenna structure of FIG. 1 to compensate for the various factors considered above. An example of a modified structure which has produced satisfactory performance is shown in FIGS. 3A and 3B. The thick and thin elements 10 and 12 are here again cylindrical in shape as in FIG. 1. In this antenna, each of the thick elements 10, except the first 10-1 and last 10-5, has a short section 30 of high impedance, substantially equal to the impedance of a section of corresponding length of the thin element 12, just beyond is input. Additionally on most of the thin elements 12 there is attached a cross member 32, which is less than a quarter wave long. Cross member 32 effectively acts as a shunt capacity.

Typical dimensions for the elements of a typical antenna constructed in accordance with the structure of FIG. 3 are shown on the chart below in terms of parts of wavelength at the center frequency of the operating band. The reference letters correspond to those on the drawing. It should be noted that the sum of the two portions of a thick element and the short piece of high impedance line 30 that it incorporates is somewhat less than one-half wavelength.

| | |
|---|---|
| a = .43λ | d = .016λ |
| b = .36λ | e = .30λ |
| c = .015λ | f = .1λ |

The use of the short member 32 on the thin elements and the high impedance sections 30 on the thick elements serve as a means for adjusting-the current distribution of the structure to more closely approximate that of the idealized transmission line case of FIG. 2.

Figure 4:
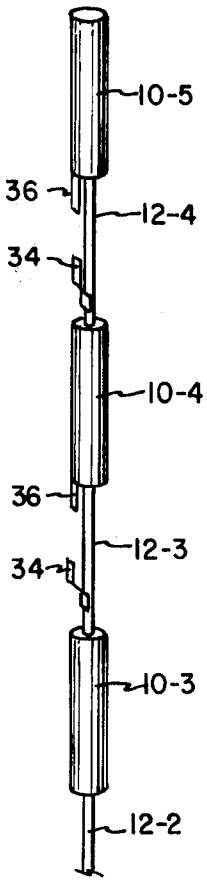
FIG. 4 is a view of a portion of an antenna in accordance with the invention showing shunt capacity members.

Other arrangements can be used for achieving the desired current distribution along the array. One such arrangement is shown in FIG. 4 and utilizes shunt capacity members 34 and 36 protruding from the elements 10 and 12. Members 34 and 36 are metal tabs. Members 34 are connected to the thin elements 12 and bent back to be substantially parallel to these elements. Members 36 are connected to the ends of the thick elements 10 and overlie the thin elements 12 in a generally parallel relationship. In this way, the thin elements 12 are capacitively loaded. Both elements 34 and 36 could be connected to the thin element 12 or to the thick elements 10, depending upon the lengths of these elements.

The direction of the radiation pattern maximum with respect to the axes of the antenna structures of the type described herein varies with frequency. It has been found when this direction is adjusted to be 90 degrees to the axis at the center of a given operating band, at operating frequencies below this the pattern tilts toward the fed end of the structure and that at frequencies above the center frequency it tilts away from it. This effect is in many cases the one which limits the frequency range (bandwidth) which can be served by a given structure. In the antennas of the subject invention, when this range is not sufficient, a range approximately twice as large can be obtained by centerfeeding an assembly comprised of two structures each of which is half as long as the one being replaced. This is shown in FIGS. 5A and 5B in each of which two collinear three element arrays are used to produce a pattern of essentially the same beamwidth and gain as that produced by the assembly of FIG. 3.

Figure 5A:
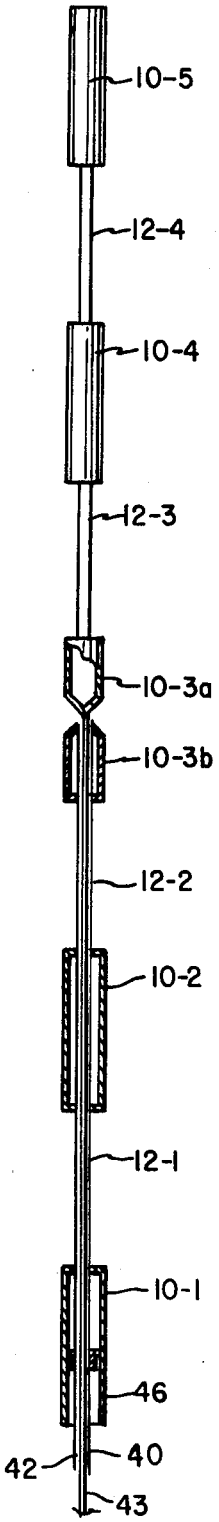
FIGS. 5A and 5B show a further embodiment in which the antenna is formed by an assembly of two structures fed in different ways.
Figure 5B:
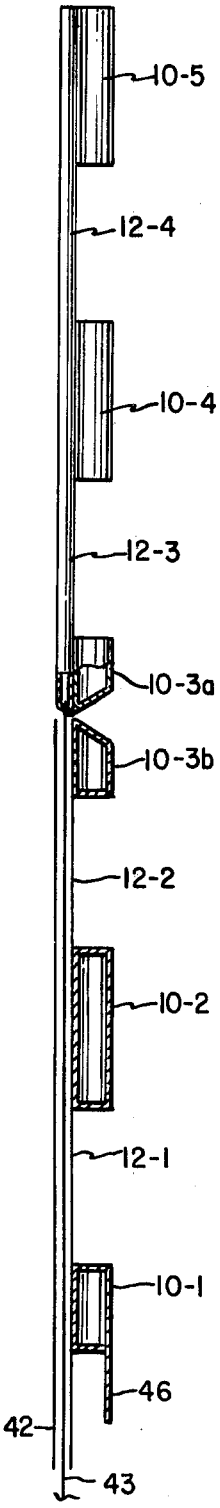

In FIGS. 5A and 5B the middle thick element 10-3 is split into two parts 10-3*a* and 10-3*b* each substantially one quarter wavelength long. The upper structure includes elements 10-5, 12-4, 10-4, 12-3 and 10-3*a* while the lower structure includes elements 10-3*b*, 12-2, 10-2, 12-1 and 10-1. The excitation of the two structures takes place at the junction between the two sections 10-3*a* and 10-3*b* of the element 10-3.

In FIG. 5A the energy is brought up to the junction through a coaxial cable 40 which is located within the lower structure. The outer conductor 42 of the cable 40 constitutes the thin elements 12-1 and 12-2 of the lower half of the radiating structure. The outer conductor 42 also supplies energy to the thick elements 10-1 and 10-2. The center conductor 43 of the cable 40 feeds the element 10-3*a* and the elements above it.

In the antenna of FIG. 5B, the coaxial cable 40 runs along the edge of the antenna. Here the center conductor 43 is connected to the lowest element 10-3*a* of the upper half structure.

In each of FIGS. 5A and 5B a quarter wave choke 46 is provided at the lower end of the lowest element 10-1 to prevent current from flowing from the outside of the lowest thick element to the outside of the input cable. The quarter wave choke 46 is shown as comprising one half of the lowest cylindrical element 10-1.

FIGS. 1 and 3–5 show various direct means of constructing the thick and thin elements of the antenna. Other embodiments are possible and some of these are described below.

Figure 6:
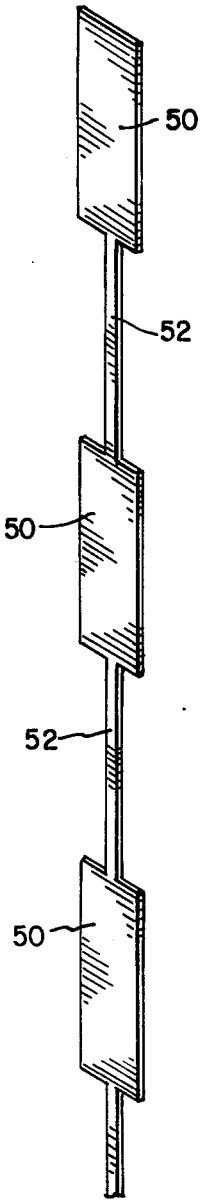
FIG. 6 shows an antenna of the subject invention wherein the various members are made of flat sheet metal or formed by etched circuit techniques such as metal coating on a dielectric substrate.

FIG. 6 shows a portion of a structure in which the various thick and thin elements 50 and 52 are cut from flat sheet metal or formed by etched circuit techniques, such as metal coating, on a dielectric substrate.

The sheet metal elements may be left flat or they can be rolled or bent to form collinear cylinders or prisms. When this type of construction is used the cracks where the edges of the sheet metal abut may be left unjoined. In FIG. 6, the feed means are not shown. Any suitable means for making the elements rigid and mounting them in a rigid manner can be used, for example, a common mast to which both the thick and thin elements are attached, a mast which serves as the thin elements and to which the thick elements are attached, etc. Also, the elements can be trimmed or loaded in the manner previously described.

Structures like those of FIG. 6 can be used to form the antennas of FIGS. 5A and 5B. Here the lower half of the structure is constructed of sheet metal, rolled or bent to comprise a housing for the cable to pass through as in FIG. 5A or lie along as in FIG. 5B.

Figure 7A:
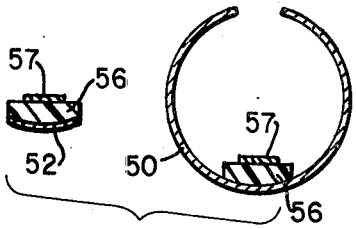
FIGS. 7A, 7B and 7C are cross-sections of an antenna according to the invention showing several energy feed arrangements.
Figure 7B:
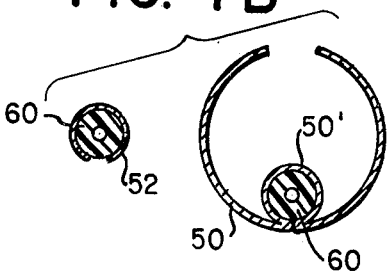
Figure 7C:
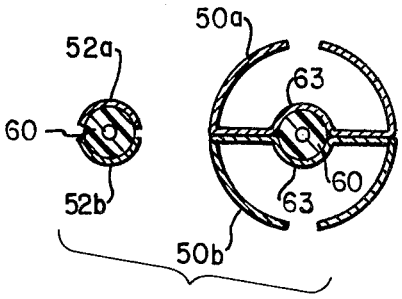

Several possible feed configurations for the antennas of FIGS. 5A and 5B using flat plates for the elements are shown in cross-section in FIGS. 7A, 7B and 7C.

In FIG. 7A a respective flat metal piece 50 has been bent to form each one of the thick elements 10-1, 10-2 or the lower half of 10-3. A suitable insulating strip such as a dielectric member 56 is mounted on the inside of the plate and a conductive strip 57 is located on top of the dielectric member 56. The dielectric member 56 can be fastened to the plate 50 by any suitable mechanical means or by an adhesive. The strip 57 can be laid down on member 56 by any suitable technique, such as printed circuit, vapor deposition, etc. The strip 57 is capable of propogating radio frequency energy at the operating frequency of the antenna. The plate 52 is bent to form a cylinder with a gap between the ends of the plate.

The dielectric member 56 passes through a thick element and is also attached to the inner face of a thin element, here shown as the plate 52. The thin element 52 is here shown being relatively small so that only a curved radiating surface is formed instead of a cylinder. This configuration serves adequately as a radiating surface.

Referring to FIG. 5A, the dielectric member 56 would pass up through the lower half of the antenna and the strip line 57 would be connected to the upper half 10-3*a* of element 10-3. The strip line structure of FIG. 7A can be used with the antenna of FIG. 5B merely by reversing the direction of bend of plate 50 so that member 56 lies on the outside of the cylinder.

FIG. 7B shows a coaxial line 60 fed through the thick and thin elements formed from the corresponding flat metal pieces 50 and 52. Piece 50 is formed with an internal convoluted bend 50' to hold the coaxial line while piece 52 forms an incomplete cylinder. This arrangement can be used directly with the antenna of FIG. 5A. To provide a feed arrangement for the antenna of FIG. 5B, the inner convoluted surface would be formed on the outside of the cylinder.

In FIG. 7C, a pair of parallel flat plates 50*a*, 50*b* and 52*a*, 52*b*, are used. Each of the plates 50*a* and 50*b* is bent to form a respective semi-cylindrical element with a half cylindrical depression 63 on a flat face. The two semi-cylindrical members 50*a* and 50*b* comprise a thick element and together form a cylinder with an inner cylinder for holding the coaxial line 60. The two plates 52*a* and 52*b* are formed around the line 60 to provide the thin elements. This feed arrangement is satisfactory for the antenna of FIG. 5A.

Figure 8:
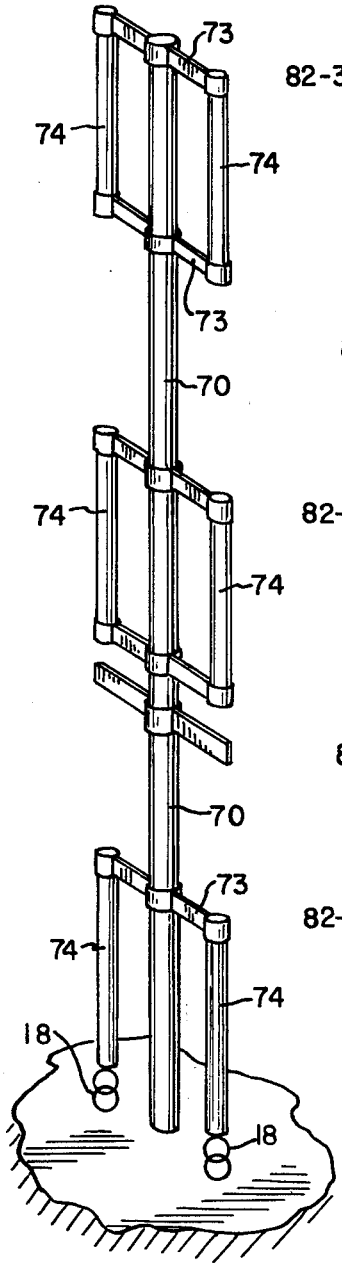
FIG. 8 is another embodiment of the invention using outriggers as members for producing the thick elements.

FIG. 8 shows a further embodiment in which a center mast 70 is used both as the supporting structure and as the thin elements of the radiating system. The thick radiating elements are achieved by ontrigger type devices 72 each of which comprises a pair of clamps 73 attached to the most and holding at each of its ends short conductive sections 74 of approximately one half wavelength long. The sections of mast 70 between each thick element is also approximately one half wavelength long. Although in FIG. 8, each thick element 72 is shown as incorporating two outriggers 84, only one, or a plurality, for example, as many as six or seven, can be used depending upon the specific requirements or particular circumstances. The greater the number of outriggers 74, the more closely the apparent surface of the outriggers approaches a cylinder. A more cylindrical configuration produces a broader bandwidth but is bulkier and more costly.

Figure 9A:
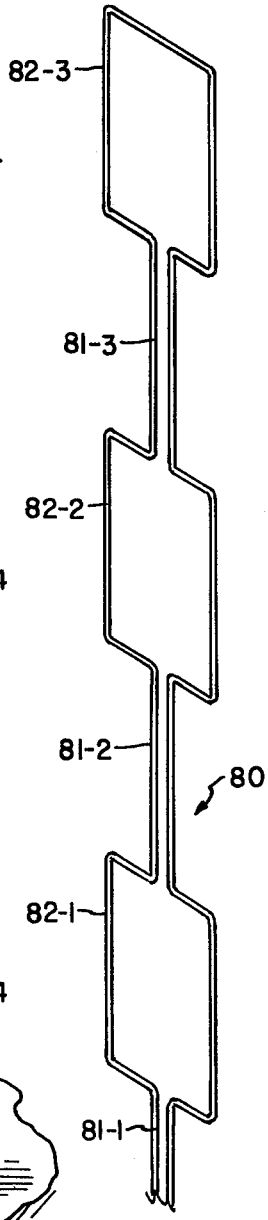
FIGS. 9A and 9B illustrate another embodiment of the invention made by bending long thin elements.
Figure 9B:
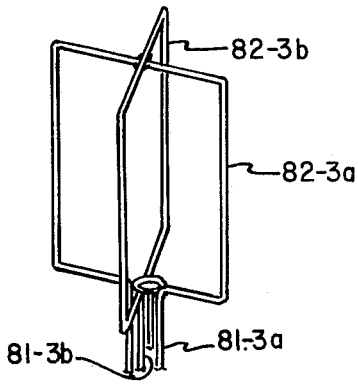

Another arrangement which has been used to make the antenna structures according to the subject invention is to form them by bending long thin elements to produce a sort of a cage-like configuration. This is illustrated in FIGS. 9A and 9B. FIG. 9A shows the unformed structure 80 as comprising a wire which is formed by any suitable process, such as bending, to make the desired thick and thin elements previously shown. The structure 80 is formed by a single wire whose path can be traced starting at the lower left-hand corner of the figure. The left-hand side of the wire first forms one side of the lowest thin element 81-1, then bent into half a rectangle to form one side of the lowest thick element 82-1, then rebent into a straight line to form one side of another thin element 81-2 and so forth. At the last thick element 82-3, the top part of the rectangle is closed and the wire is formed on the right-hand side in a pattern symmetrical to the left hand side to complete the thick and the thin elements. The feed for the structure of FIG. 9A (not shown) is at its bottom.

FIG. 9B is a partial representation of an antenna constructed in accordance with the principals of FIG. 9A. Here, two complete structures 80-2 have been placed together at right angles and are electrically connected at the top and bottom of each element. Two thick elements 82-3*a* and 82-3*b* and two thin elements 81-3*a* and 81-3*b* are shown. This forms a more continuous surface for the thick and the thin elements. As is similar in the case of the outriggers of FIG. 8, a plurality of the wire structures 80 can be combined at angles to better approximate a more complete cylindrical surface.

Figure 10:
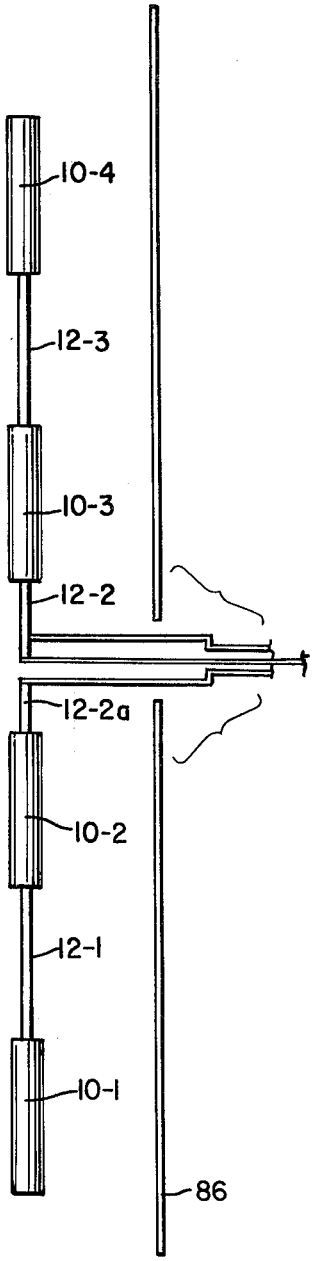
FIG. 10 is a diagram indicating an antenna according to the invention in which the energy is supplied by a balun.

FIG. 10 shows another type of antenna formed in accordance with the invention used with a reflector. Here, the thick and thin elements are designated with the same reference numerals as in FIG. 1. The center thin element 12-2 has been split into two parts 12-2*a* and 12-2*b* and the entire antenna structure is shown located in front of a long wire reflector 86 whose length is at least as long as the overall array of the elements 10 and 12. The center conductor of the balun and the upper outer conductor are connected and supply energy to the upper section 12-2*a* of element 12-3 and the elements above it while the lower outer conductor of the balun is connected and supplies energy to the lower section 12-2*b* of element 12-2 and those elements below it.

As is conventional with antenna theory, the reflector 86 serves to sharpen the directivity of the antenna. While one reflector is shown, it should be understood that a number of reflectors of the same or different lengths can be used. The reflectors can be located at various angular relationship around the antenna structure and/or an array of reflectors and/or directors can be used with the latter array located in one or more planes.

Figure 11:
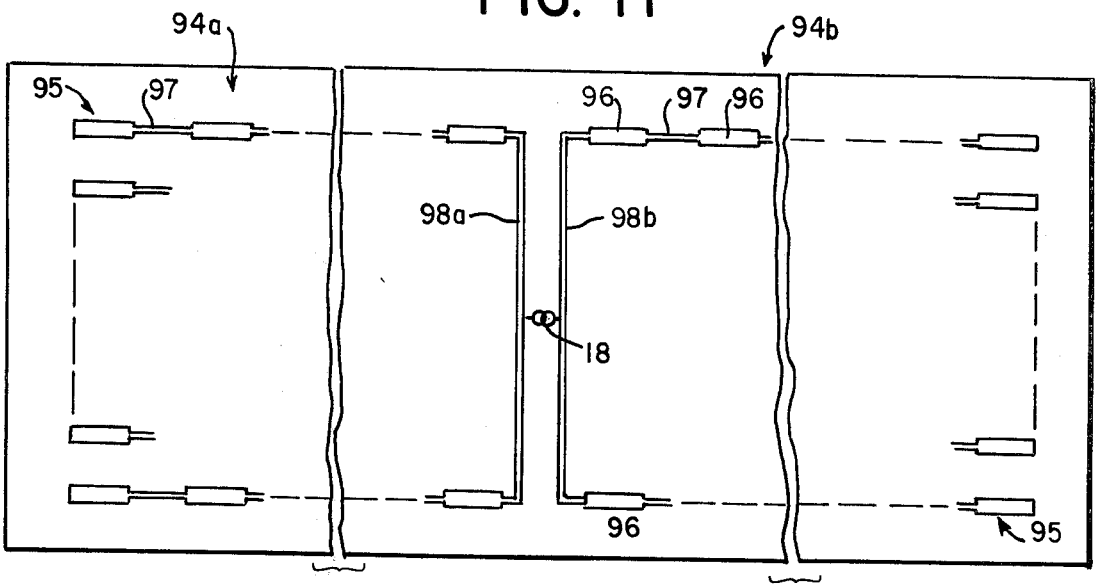
FIG. 11 shows another embodiment of the antenna made by printed circuit techniques.

Antennas according to the invention lend themselves to fabrication readily by printed circuit techniques. FIG. 11 shows the formation of a two-dimensional array of thick and thin elements. In FIG. 11, the thick and thin elements are laid out in a pair of symmetrical matrices 94*a* and 94*b*. Each matrix has a number of rows 95 of identical construction of alternate thick elements 96 and thin elements 97. A respective common column line 98 is connected at the center of the array to all of the rows at each of the two matrices 98*a*, 98*b* and energy is supplied to the antenna on both column lines 98 at the middle row of each of the two matrices. Energy can be supplied by any suitable arrangement from a signal source 18. For example, a balanced transmission line can be used or a coaxial line plus a balun.

Figure 12A:
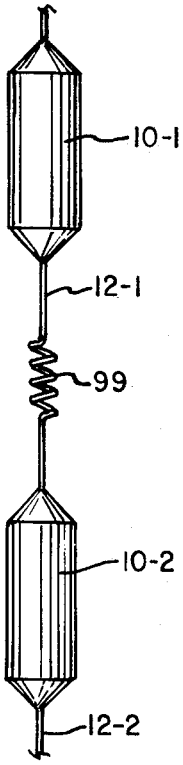
FIGS. 12A and 12B show further embodiments of the invention using inductances in series with the elements to adjust the current distribution.
Figure 12B:
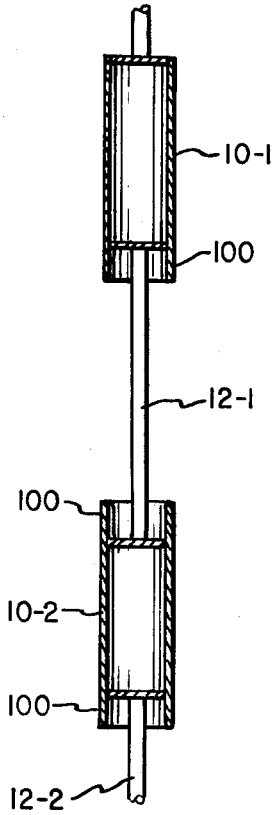

In the embodiment of FIG. 5 shunt capacity members are used to adjust the current distribution in the antenna. FIGS. 12A and 12B show further embodiments of the invention in which inductances such as coils or chokes are used in series with the elements to achieve the desired current distribution.

In FIG. 12A, a lumped inductance 99 is shown in series with one of the thin elements. In FIG. 12B a choke 100 in the form of a collar is located in the thick elements. The chokes 100 can be either at the input or output end of the thick element or at both ends.

The values of the inductances, lumped or chokes, can be selected to achieve the desired current distribution. The inductances can be used on any one or more of the thick or thin elements depending on the current distribution desired.

In constructing antennas according to the subject invention, it is frequently advantageous to combine a number of different size and type elements in the same array. An antenna of this type is shown in FIG. 13.

Figure 13:
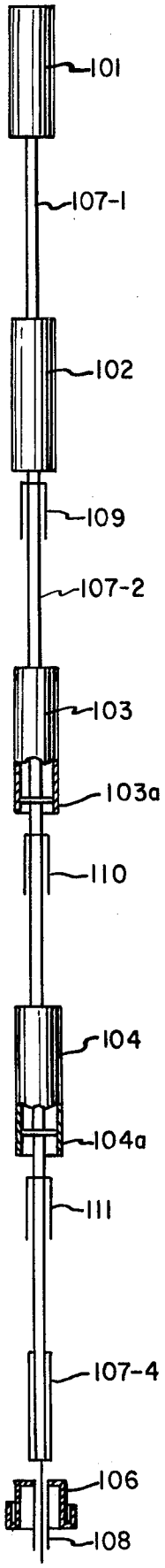
FIG. 13 is a view of another embodiment of the invention showing different size and type elements in the same array.

In FIG. 13, elements 101 and 102 are the two of the thick elements as are elements 103, 104 and 105. Elements 101, 102, 103 and 104 are cylinders while element 105 is a flat sheet.

Element 106, located between the lowest thick element 105 and the energy source (not shown) is a folded choke of generally cylindrical shape. The choke has an extending flange portion 106*a* on its bottom.

Each of the thick elements 103 and 104 has a small inductive choke, respectively designated 103*a* and 104*a*, at its input end. As in the various examples of antennas previously described, using chokes, the chokes serve to vary the current distribution along the length of the antenna array.

Each of the thin elements 107-1, 107-2, 107-3, 107-4, is a rod or other similar generally cylindrical member.

The energy input to the antenna of FIG. 13 is a coaxial line 108. As shown, the outer conductor of the coaxial line is connected to the folded choke 106 at the input end of the array. The inner conductor of the line is connected to the lowest thick element 105 which in turn is electrically connected to all of the elements in the array above it.

It is preferred that the entire antenna assembly of FIG. 13 be enclosed in a protective unit, for example, a hollow fiber glass most, when in use.

The chart below indicates the various dimensions at the center frequency for a typical antenna of the type shown in FIG. 13 which has been constructed in accordance with the invention.

| | |
|---|---|
| Element 101 | |
| a. Diameter | = .07λ |
| b. Length | = .32λ |
| Element 102 | |
| a. Diameter | = .1λ |
| b. Length | = .4λ |
| Element 103 | |
| a. Diameter of element 103 | = .1λ |
| b. Length of element 103 (including choke 103a) | = .36λ |
| c. Length of choke 103a | = .03λ |
| Element 104 | |
| a. Diameter of element 104 | = .07λ |
| b. Length of element 104 (including choke 104a) | = .36λ |
| c. Length of choke 104a | = .05λ |
| Element 105 - flat sheet | |
| a. Length | = 37λ |
| b. width | = .05λ |
| Element 107 | |
| a. Diameter of elements 107-1 thru 107-4 | = .017λ |
| b. Length of element 107-1 | = .37λ |
| c. Length of element 107-2 (from bottom of 102 to top of 103) | = .48λ |
| d. Length of element 107-3 (from bottom of 103a to top of 104) | = .485λ |
| e. Length of element 107-4 (from bottom of 104a to top of 105) | = .485λ |
| Elements 109 and 110 - folded flat sheets | |
| a. Length | = .14λ |
| b. Width | = .05λ |
| Spacing from bottom of 102 to top of 109 | = .03λ |

-continued

| | |
|---|---|
| Spacing from bottom of 103a to top of 110 | = .05λ |
| Choke Element 106 | |
| a. Length | = .12λ |
| b. Diameter of upper part | = .1λ |
| Distance from top of choke 106 to bottom of 105 | = .37λ |

Figure 14:
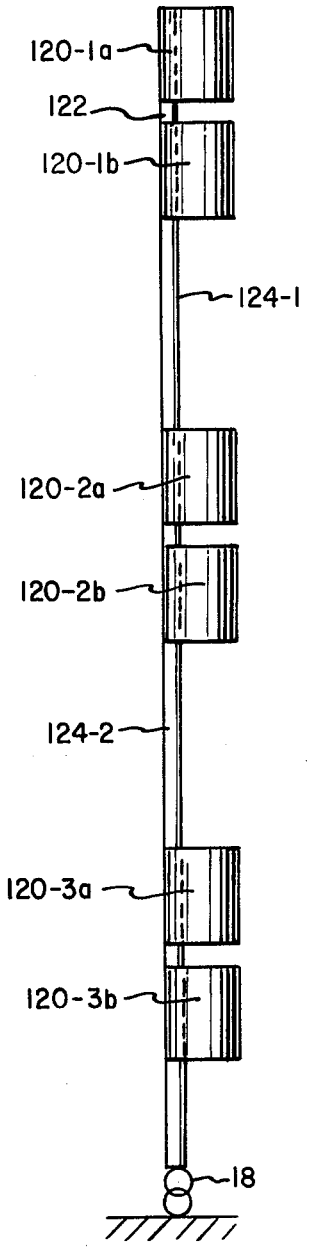
FIG. 14 shows another antenna in which the thick elements are divided into several sections.
Figure 15:
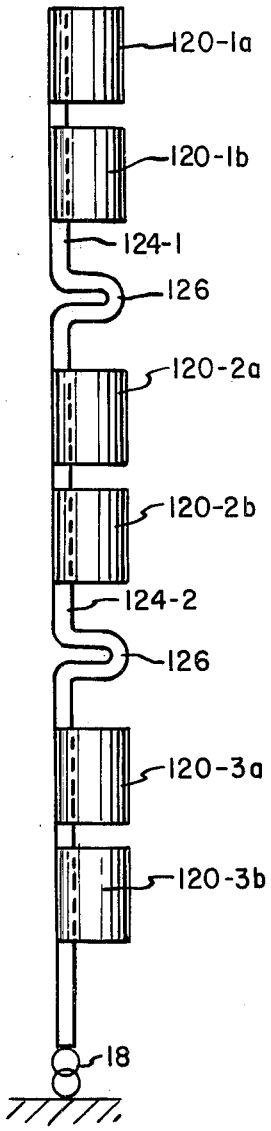
FIG. 15 shows an antenna which is a modification of that of FIG. 14.

In several of the embodiments described above, the idealized structure of FIG. 1 was modified to produce the desired current distribution along the length of the antenna. FIGS. 14 and 15 show two structures which have been found to be particularly advantageous in achieving a desired current distribution. In general, the antennas of FIGS. 14 and 15 are formed by dividing each of the thick elements approximately midway along its length into two sections such that each is slightly less than a quarter wavelength in length. The two sections are connected together with a short section of a relatively thin conductor.

In FIG. 14, each thick, generally cylindrical element 120 is shown divided into two sections respectively designated 120-1*a*, 120-1*b*; 120-2*a*, 120-2*b*; and 120-3*a*, 120-3*b*. Each of the a and b sections of the elements 120 is connected by a short section of a thin element 122. The three thick elements 120 are in turn electrically coupled by the two thin elements 124-1 and 124-2.

In FIG. 14, both the thick elements 120 and the thin elements 124 are straight. In a typical antenna, each thick element is approximately 0.45 wavelength in length, including the length of the respective thin mid-section 122. Each thin element 124 is approximately 0.5 wavelength in length. It should be understood that actual assembly of an antenna according to FIG. 14 might be substantially physically longer overall as a result of including a larger number of elements than in the example shown.

In FIG. 14, it is noted that the thin elements 124 are not in line with the central axes of the thick elements 120 but rather are essentially in line with the outer surface of the thick elements.

A construction with the thin elements 5 in line with the surface of the thick elements, it is applicable to the other embodiments of the invention shown in FIGS. 1, 3–6 and 1–13. Likewise, the basic idea disclosed here, of making the thick elements of two in-line parts, e.g. a split cylinder, is applicable to those structures in which the relationship of the axes of the thick and thin element 55 is different, such as FIGS. 1, 3, 4, 5 and 10–13.

Without changing the lengths of the elements it is possible to reduce the spacing between the thick elements by folding or coiling the thin elements. This is shown in FIG. 15 in which the two thin elements 124-1 and 124-2 have generally U-shaped bends 126 of their approximate midpoints. The overall length of elements 124 when straightened correspond to the length of an element 120. By making the bends, the beamwidths and the minor lobe level of the antenna pattern is altered. In FIG. 15, the operation of the array is similar to that of FIG. 14 but its side lobes are slightly smaller and its main lobe slightly broader.

Antenna structures of the types shown in FIGS. 14 and 15 can be conveniently fabricated by soldering or otherwise attaching hollow sheet metal cylinders to a long slender metal rod or wire. The cylinders can, of course, alternatively be made in other ways, e.g. metal grid, open cages, etc.

The various antennas of the subject invention can be modified in a variety of ways. For example, in the various embodiments described hereinabove, the physical lengths of each of the thick and thin elements is approximately one-half wavelength. It should be understood that the principals of the invention are concerned with the electrical length of each of the elements rather than the actual physical lengths. For example, the actual physical lengths of the various thick and thin elements can be shortened by embedding the physical portions of the elements, or parts of them, in dielectric material to shorten the physical length needed to achieve the desired electrical lengths.

Also, as in the case described with respect to FIG. 15, the overall lengths of the antennas can be reduced by bending the thin elements. The thin elements also can be coiled, for example as a helical coil, to achieve both a reduction in length and the addition of a series inductance.

The majority of the embodiments of the invention disclosed use a conductive connection between the thick and thin elements. It should be understood that this is not entirely necessary. As is consistent with antenna operating principles, the thick and the thin elements can be connected through low impedance capacitances. This form of construction can be used, for example, to avoid soldering, to enhance corrosion resistance or to lower assembly costs or for other reasons.

The dimensions shown for the various antennas are typical dimensions. Various models of antennas have been constructed successfully in which the thick and thin elements were in the range of between 0.25λ to 0.5λ in length and the distance between corresponding points on thick elements between 0.65λ and a full wavelength.

In addition, the ratios of diameters of the elements, in those cases where this phrase is applicable, has been as great as 25 to 1 and as little as 2 to 1. Diameters and widths of elements on successful models have not generally exceeded 0.25λ.

While the antennas described have incorporated four or five thick elements and three or four thin elements, it should be understood that this is in no way to be construed as limiting on the scope of the invention. By extending the array to greater numbers of elements, the radiation pattern of the antenna can be sharpened to increase the gain of the main lobe.

All of the various cylindrical elements shown in the embodiments of the invention can be fabricated in any way. For example, they can be fabricated by soldering or otherwise forming sheet metal. The cylinders can also be made by metal grids, open cages, etc.

What is claimed is:

1. An antenna for transmitting and receiving radio frequency energy over a given band of frequencies comprising an array formed by a plurality generally cylindrical first and a plurality of generally cylindrical second elongated radiating elements alternately arranged and electrically coupled in series, each of said first and second elements being linear and substantially straight along the length thereof and capable of radiating and receiving the radio frequency energy, each of said first and second elements being substantially electrically one-half wavelength long at the center frequency of said band of frequencies, and having a physical length of substantially between about one-quarter to one-half wavelength long measured at the center frequency of said band of frequencies, the energy radiating surface area of each of said plurality of first elements being greater per unit length than the energy radiating surface area per unit length of each of said plurality of second elements and said first elements having a lower characteristic impedance than said second elements to thereby radiate more energy than said second elements, and means for electrically coupling said energy to or from each of said elements serially along the length of the array with the energy at all of said first elements being substantially in phase and the energy at all of said second elements also being substantially in phase but in phase opposition to the energy at said first elements.

2. An antenna as in claim 1 further comprising means for varying the current distribution of the energy radiating surface area of at least one of the elements along the length of the antenna.

3. An antenna as in claim 2 wherein said means for varying the current distribution comprises capacitance means.

4. An antenna as in claim 3 wherein said capacitance means are coupled in shunt to certain of said elements.

5. An antenna as in claim 1 further comprising means for coupling energy to or from the antenna at one end thereof.

6. An antenna as in claim 1 further comprising means for coupling energy to or from the antenna at an intermediate portion thereof.

7. An antenna as in claim 6 wherein one of the elements intermediate of the length of the antenna is divided into two parts, said energy coupling means coupled to each of said parts and through said parts to the respective elements electrically connected thereto.

8. An antenna as in claim 1 wherein all of said elements lie along a common axis.

9. An antenna as in claim 8 wherein said axis is the central axis of all of said elements.

10. An antenna as in claim 8 wherein said axis is offset from the center of each of said elements.

11. An antenna as in claim 1 further comprising elongated means for coupling energy to or from said elements, said elements lying along said coupling means as a common axis.

12. An antenna as in claim 11 wherein said elongated energy coupling means is the central axis of all of said elements.

13. An antenna as in claim 11 wherein said elongated energy coupling means also comprises certain of said elements.

14. An antenna as in claim 1 further comprising at least one elongated radio frequency energy reflector means adjacent to said elements along at least a part of the antenna length.

15. An antenna as in claim 14 further comprising means for coupling radio frequency energy to said elements at an intermediate point along the array.

16. An antenna as in claim 1 wherein there are a plurality of said arrays, and means for coupling the radio frequency energy to or from all of said arrays.

17. An antenna as in claim 1 wherein said plurality of first elements each have substantially the same radiating surface area per unit length, and said plurality of second elements each have a radiating surface area per unit length different from that of the first elements, and certain of said second elements having radiating surface areas different from each other.

18. An antenna as in claim 1 further comprising means for modifying the current distribution of certain of said elements.

19. An antenna as in claim 1 wherein certain of said elements are found in two parts electrically connected by a means having a smaller radiating surface area than the areas of the sum of the two parts.

20. An antenna as in claim 1 wherein selected ones of said second elements are formed in two separate parts electrically coupled by means of higher electrical impedance than either of said parts.

21. An antenna as in claim 1 wherein the effective electrical length of the second elements of lesser surface radiating area is at least about $0.4\lambda$ at the center frequency of operation of the antenna.

22. An antenna as in claim 1 wherein the effective electrical length of all the elements is substantially the same.

23. An antenna as in claim 1 wherein each of said first elements is of a physical length substantially one-half wavelength long at the center frequency of the energy coupled thereto and each of said second elements is of a physical length substantially between about one-quarter to one-half wavelength long at the center frequency of the energy coupled thereto.

24. An antenna as in claim 23 wherein said elements are electrically conductively coupled end-to-end.

* * * * *